United States Patent [19]

Stefanelli

[11] Patent Number: 5,001,615

[45] Date of Patent: Mar. 19, 1991

[54] POSITIVE INTERLOCK ASSEMBLY

[75] Inventor: Anthony Stefanelli, Hauppauge, N.Y.

[73] Assignee: Minami International Corporation, New York, N.Y.

[21] Appl. No.: 478,646

[22] Filed: Feb. 12, 1990

[51] Int. Cl.[5] ..... H01R 33/00

[52] U.S. Cl. ..... 362/226; 439/611

[58] Field of Search ..... 362/226, 236, 237, 249, 362/353, 806, 452, 443, 252; 439/611, 616, 617, 356

[56] References Cited

U.S. PATENT DOCUMENTS

| | | | |
|---|---|---|---|
| 2,105,531 | 3/1983 | Croker | 439/356 |
| 3,182,185 | 5/1965 | Ahroni et al. | 362/806 |
| 3,286,088 | 11/1966 | Ahroni | 362/226 |
| 4,667,276 | 5/1987 | Cheng | 362/806 |
| 4,679,126 | 7/1987 | Van Sickler | 362/226 |
| 4,777,573 | 10/1988 | Liao | 362/806 |
| 4,795,121 | 1/1989 | Comito | 362/806 |
| 4,807,098 | 2/1989 | Ahroni | 362/249 |
| 4,943,899 | 7/1990 | Tseng | 362/226 |

OTHER PUBLICATIONS

Advertising sheet (one page) for Prem-O-Snap connector, (no date given).

*Primary Examiner*—Stephen F. Husar

*Attorney, Agent, or Firm*—Amster, Rothstein & Ebenstein

[57] ABSTRACT

A lamp base/husk assembly comprises an elongate lamp base and an elongate husk configured and dimensioned to receive coaxially and telescopically therein (and to release therefrom) a portion of the lamp base. A lug-and-locking element combination, integral in part with the lamp base and in part with the husk, is provided for effecting a positive interlock of the lamp base and husk in a coaxial and telescoped disposition (and for releasing such interlock) by a manual movement independent of the manual movement required to effect receipt of the lamp base and husk in the coaxial and telescoped disposition (or the separation of the lamp base and husk therefrom).

13 Claims, 5 Drawing Sheets

12
25
54
40
50
24
42
44
50a
46
14
52
24
56
58
56
58
27
30
32
28
34
16
29
26
20

6

12
14
25
40
42
44
24
50
30
34
50a
27
16
46
28
26
29
52
54
20
6

POSITIVE INTERLOCK ASSEMBLY

BACKGROUND OF THE INVENTION

The present invention relates to miniature lights (such as Christmas tree lights) and, more particularly, to such lights having a positive interlock between the lamp base and the husk which receives the lamp base.

Strings of small or miniature lights are commonly employed on Christmas trees and on various natural and artificial elements (such as living trees and roofs or windows) during festive or religious occasions. Typically a series of elongate husks are disposed in series, parallel or series-parallel relationship on one or more sets of electrical wires. Each husk is configured and dimensioned to releasably receive coaxially and telescopically therein at least a portion of an elongate lamp base and provide either steady or intermittent energization of a lamp disposed in and secured to the lamp base. The lamp base is secured to the husk by either a rotational threaded screw type connection or by a non-rotational push-in friction fit or interference fit type connection. The present invention is directed primarily to the non-rotational or push-in type connection between the husk and lamp base. A particular problem encountered with the push-in type connection is that the lamp base (or lamp/lamp base subassembly) becomes loose within the husk and may even separate from the husk during use, as a result of accidental touching thereof, vibration thereof, or the like, thereby de-energizing not only its own lamp but also any other lamps in the series circuit.

A variety of different attempts have been made to lock the connection between the lamp base and husk so as to preclude such loosening and accidental separation of the members (that is, the lamp base member and the husk member). In one type of lockinq mechanism the lock is effected by a resilient engagement—that is, a resilient locking post on the husk is cammed radially outwardly by a flange or rim on the lamp base as the lamp base is inserted into the husk and, when insertion is completed and the camming ends, resiliently returns to its original orientation and thereby latches onto the flange. In this manner, the natural resiliency of the post acts to keep the lamp base secured to the husk against accidental displacement due to incidental touching, vibration or the like, yet permits intentional forcible removal thereof for replacement of the lamp/lamp base subassembly when necessary. In this type of connection the camming of the resilient latch member is effected by relative movement of the husk and lamp base along their common axis and, accordingly, the simple forcible pulling of the lamp base from the husk along their common axis suffices to break the lock therebetween.

In another type of locking mechanism, the lock is formed by a third member, such as a spring clip accessory which simultaneously engages both the upper rim of the lamp base and the upper rim of the husk, to keep the two members together. This type of connection requires molding of the third member (i.e., the spring clip), and thus additional expense. Further, the spring clip may fall off during use and, once separated from the other members, is easy to lose.

Accordingly, it is an object of the present invention to provide a positive interlocking lamp base/husk assembly.

Another object is to provide such an assembly in which the positive interlocking means is integral with the lamp base and/or husk so that it does not need to be separately molded and cannot become lost.

A further object is to provide such an assembly wherein the positive interlock is effected by a manual movement other than that normally used to join together or separate the husk and lamp base assembly member.

SUMMARY OF THE INVENTION

It has now been found that the above and related objects are obtained in a push-in lamp base/husk assembly comprising an elongate lamp base member and an elongate husk member configured and dimensioned to receive coaxially and telescopically therein, and to release therefrom, a portion of the lamp base member. Means, integral in part with the lamp base member and in part with the husk member, are provided for effecting a positive interlock of the members in a coaxial and telescoped disposition (and releasing the interlock) by a manual movement independent of the manual movement required to effect receipt of the members in the coaxial and telescoped disposition (or separation of the members therefrom). Preferably, the members are disposed in the coaxial and telescoped disposition (and separated therefrom) by relative axial movement thereof and the interlocking means effects such positive interlock (and release thereof) by a non-axial movement of the interlocking means.

More particularly, in a push-in assembly, one of the members (preferably the husk member) defines a first housing and an integral outwardly projecting lug, and the other of the members (preferably the lamp base member) defines a second housing and an integral locking element. The locking element has a free end portion, a living hinge connecting the second housing and the free end portion, and an aperture extending through the free end portion configured and dimensioned to receive therein a portion of the lug to positively interlock the members. The free end portion is repeatedly movable relative to the second housing at the living hinge, between a locking orientation wherein the lug extends through the aperture and a releasing orientation wherein the lug does not enter the aperture, by manual movement of the free end portion independent of the manual movement required to effect either receipt of the lamp base member within the husk member or release of the lamp base member from the husk member. In other words, the members are configured and dimensioned such that the manual movement required to effect either receipt of the lamp base member within the husk member or release of the lamp base member from the husk member is a substantially axially directed movement, and the manual movement of the free end portion between the locking orientation and the releasing orientation is a substantially non-axially directed movement.

In a preferred embodiment, the free end of the lug is disposed to one side of the free end portion of the locking element in the locking orientation and on the opposite side of the free end portion of the locking element in the releasing orientation. In the locking orientation the aperture and the lug form an interference fit.

The free end portion may extend substantially beyond the aperture so that in the locking orientation the length of the free end portion beyond the aperture defines with the lug and first housing of the one member a generally inverted U-shaped recess for support of the assembly as a unit on an external support. The locking element preferably additionally includes an outwardly projecting portion intermediate the second housing and the living hinge, the intermediate portion of the locking element being substantially rigid and the free end portion thereof being at least relatively rigid.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
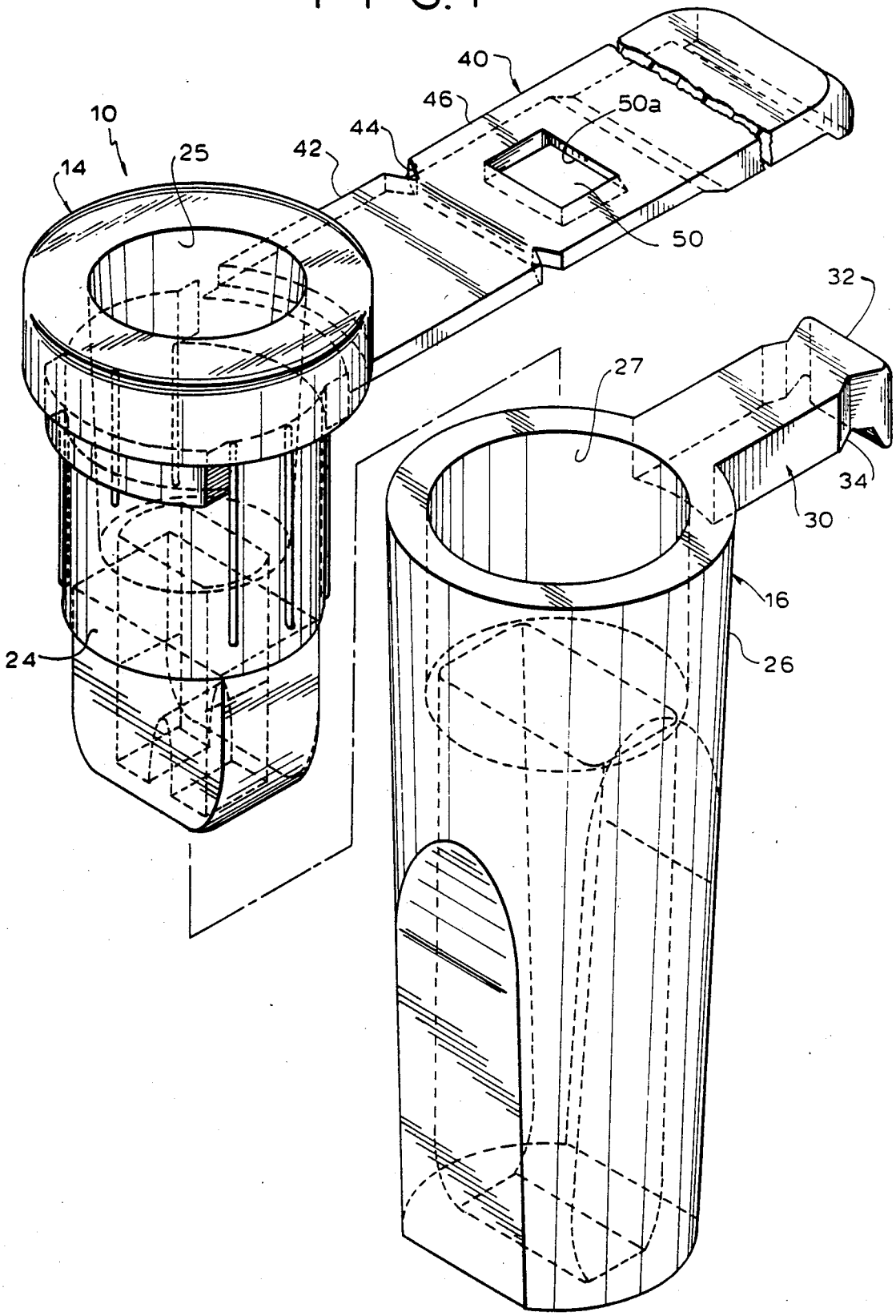
FIG. 1 is an exploded isometric view of a push-in lamp base/husk assembly according to the present invention in conjunction with a lamp, with the clip in the releasing orientation.

Referring now to the drawing, and in particular to FIGS. 1–3 and 6 thereof, therein illustrated is an assembly 10 according to the present invention and generally designated by the reference numeral 10. In its conventional aspects the assembly 10 comprises a lamp 12 (see FIGS. 2–3), a lamp base generally designated 14, and a husk generally designated 16. The lamp 12 and lamp base 14 together constitute a non-rotational push-in lamp/lamp base subassembly. The lamp base 14 includes a substantially rigid, electrically insulative, hollow elongate housing 24 defining an aperture 25 at the top thereof for partial receipt therein of the lamp 12, and the husk 16 includes a substantially rigid, electrically insulative, hollow elongate housing 26 defining an aperture 27 at the top thereof for partial receipt therein of the lamp base 14. As is conventional and illustrated in FIGS. 3 and 6, the lamp base 14 contains openings therethrough for electrical contacts 28 from the lamp 12 for establishing electrical connection between the electrical circuit of the lamp 12 and the husk 16, while the husk 16 contains electrical contacts 29 for establishing electrical connection between the electrical contacts 28 of the lamp 12 and various electrical wires 20 connected to the husk 16 in series, parallel, or series-parallel configurations. The electrical aspects of the lamp 12 and husk 16 are conventional in nature and well known to those skilled in the miniature light art; accordingly, further details thereof are not set forth herein.

Figure 4:
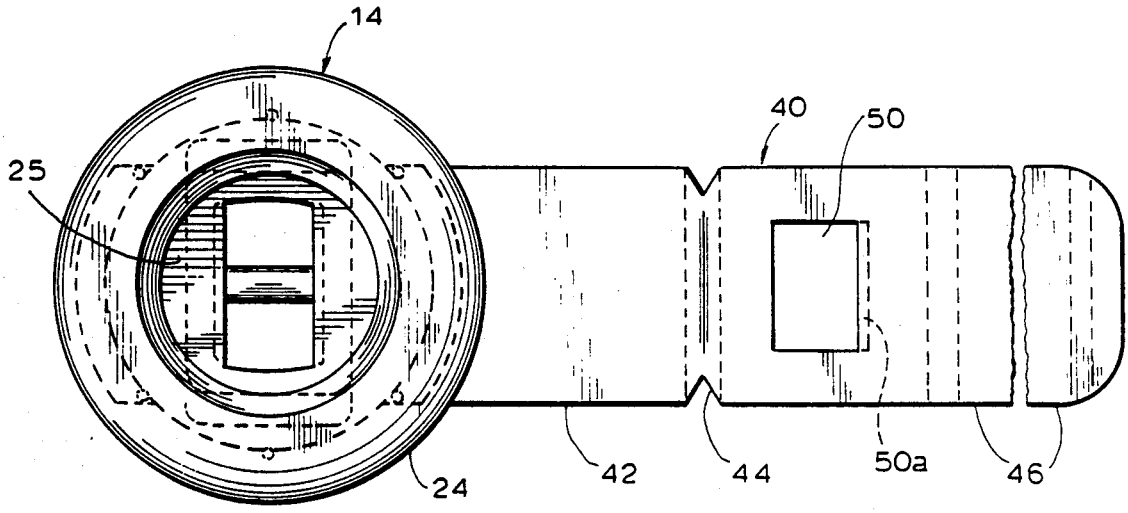
FIG. 4 is a top plan view of the lamp base, with the clip in the releasing orientation.
Figure 5:
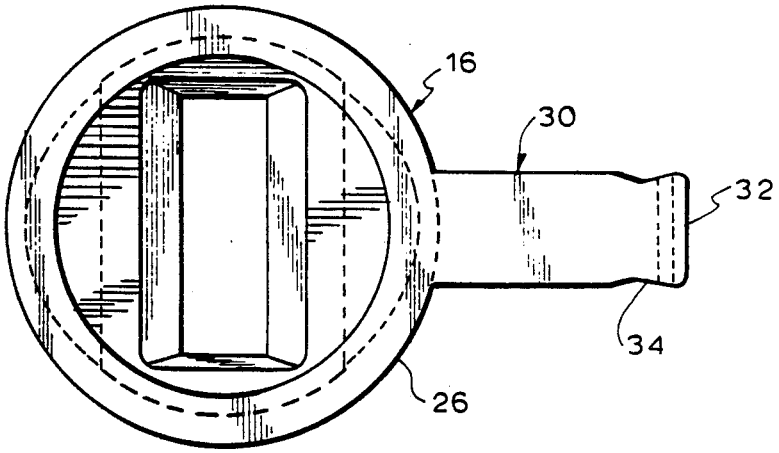
FIG. 5 is a top plan view of the husk.
Figure 6:
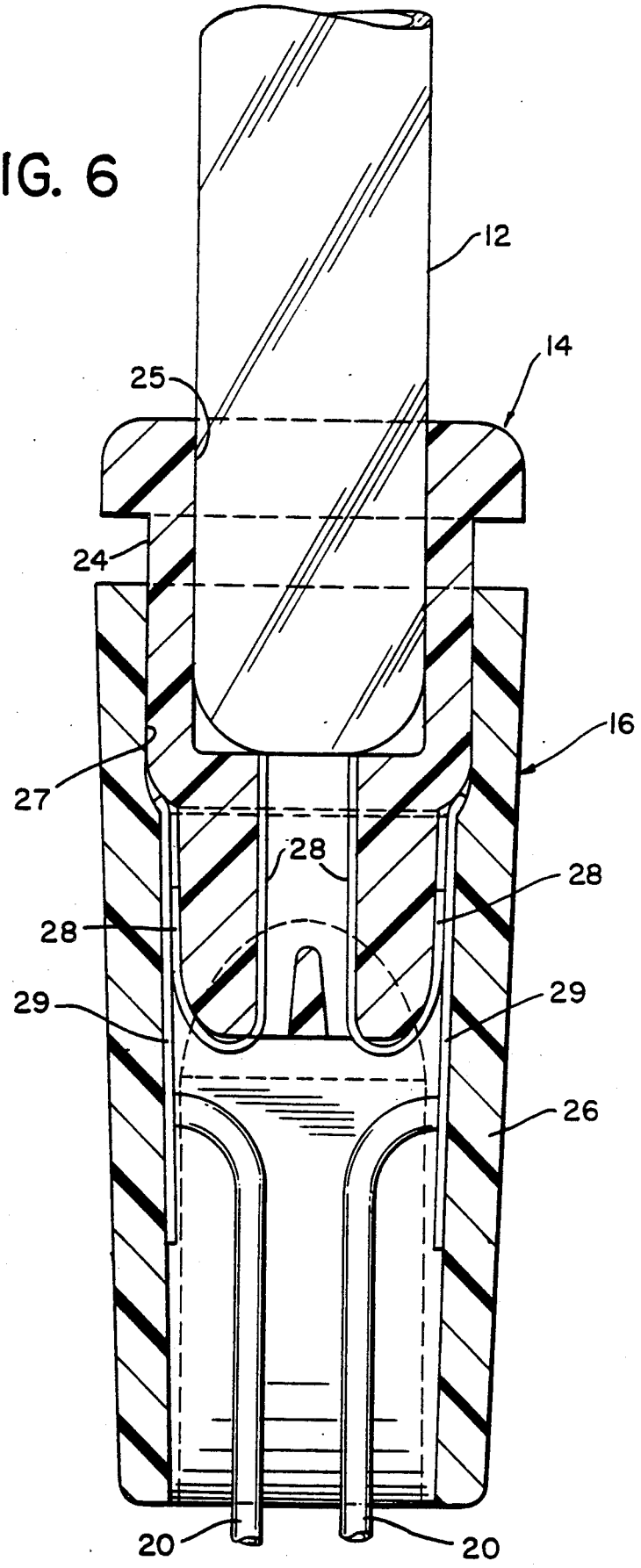
FIG. 6 is a fragmentary sectional view of the assembly taken along the line 6—6 of FIG. 3.

Turning now to the novel aspects of the present invention, and referring now also to FIGS. 4 and 5, the husk 16 defines adjacent its front end an integral lug or post generally designated 30, extending outwardly from the husk housing 26 and terminating in a free end 32. The husk housing 16 is of generally hollow cylindrical configuration, and the post 30 extends along an axis transverse to the axis of the cylinder. The post 30 is preferably substantially rigid. The bottom surface of the post free end 32 is beveled upwardly and inwardly towards the husk axis and the husk front portion receiving the lamp base 14, thereby to provide a constricted post portion 34 having a reduced cross section relative to that of the post free end 32.

The lamp base 14 defines adjacent its front end an integral clip or locking element generally designated 40. The clip 40 comprises an optional fixed intermediate portion 42, a living hinge 44, and a free end portion 46. The intermediate portion 42 is preferably rigid and is connected at one end to the lamp base housing 24 and at the other end to the living hinge 44. The living hinge 44 is typically a clip length of reduced cross section enabling the clip free end portion 46 to be moved in one plane relative to the intermediate portion 42, as if connected by a hinge. If desired, the living hinge 44 may be directly connected to the lamp base housing 24, thus dispensing with the clip intermediate portion 42. The clip free end portion 46 is preferably relatively rigid and defines adjacent living hinge 44 an aperture 50 extending therethrough. The clip aperture 50 is configured and dimensioned to snugly receive therethrough the post free end 32 so as to positively interlock said clip aperture 50 and said post 30, and thereby the lamp base 14 and husk 16.

Figure 2:
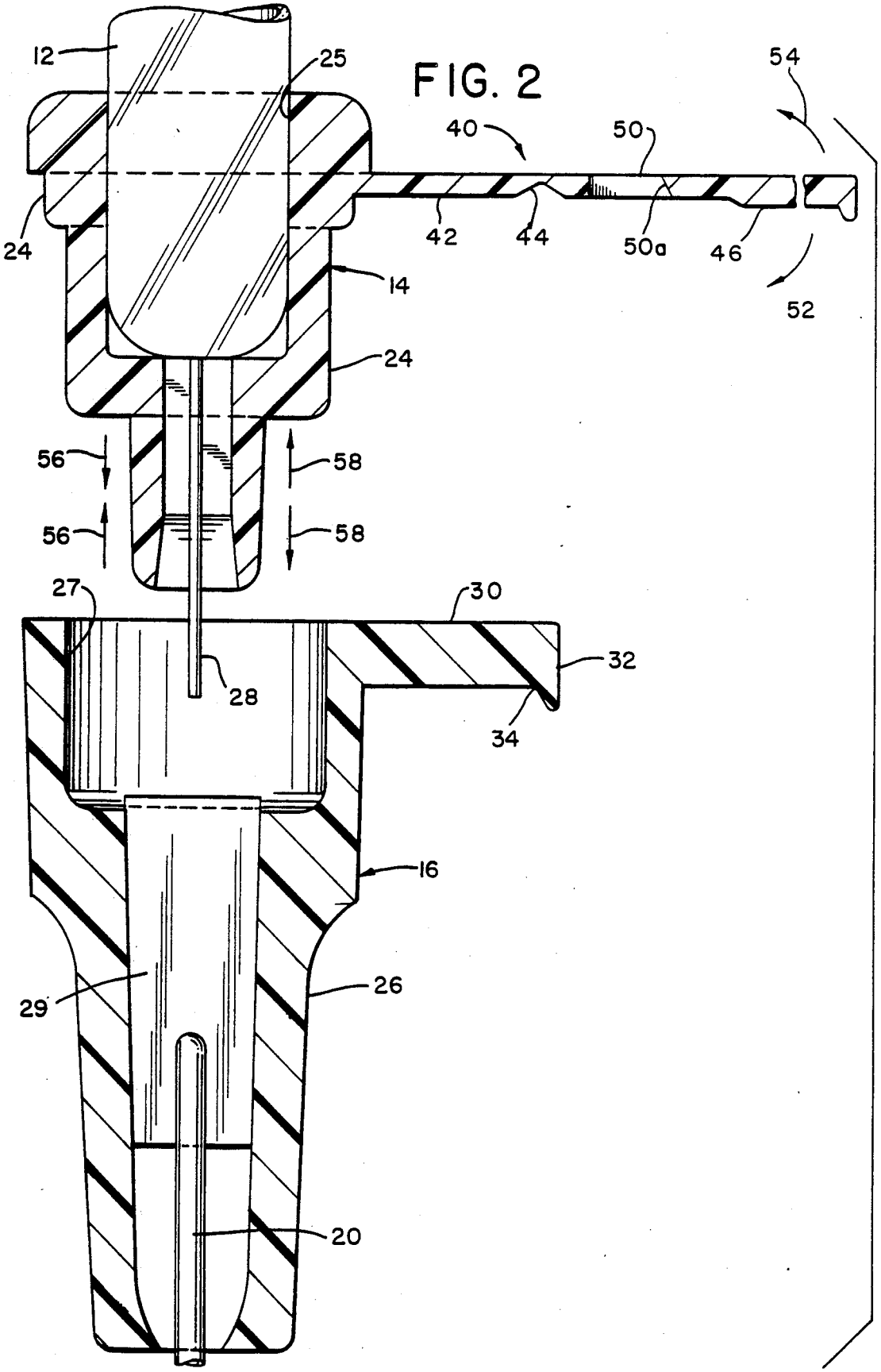
FIG. 2 is a fragmentary exploded sectional view of the assembly in conjunction with a lamp, with the clip in the releasing orientation.
Figure 3:
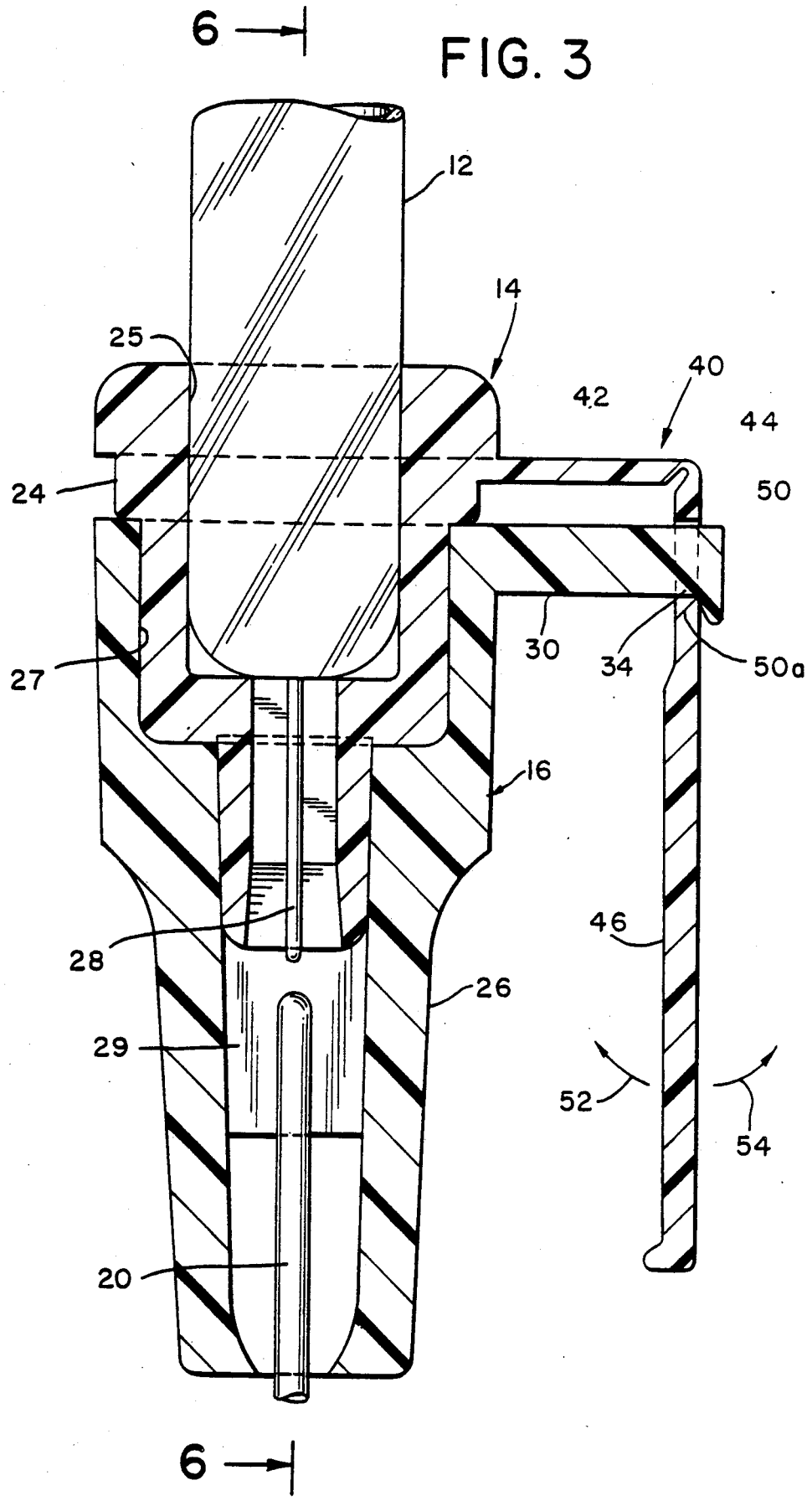
FIG. 3 is a fragmentary sectional view of the assembly, with the clip in the locking orientation.

More particularly, the living hinge 44 permits the clip free end portion 46 to be repeatedly moved, relative to the clip intermediate portion 42 and lamp base housing 24, between the locking orientation illustrated in FIG. 3 and the releasing orientation illustrated in FIGS. 1–2 and 4. In the locking orientation, which is effected by movement of the clip free end portion 46 in the clockwise direction of arrow 52, the post free end 32 extends through the clip aperture 50 to effect the desired positive interlock between the lamp base 14 and husk 16. In the releasing orientation, which is effected by movement of the clip free end portion 46 in the counterclockwise direction of arrow 54, the post free end 32 does not enter into the clip aperture 50, so that the lamp base 14 and husk 16 are easily separated or joined by movement along their common axis either apart from one another or towards one another, respectively.

It will be appreciated that the manual clockwise or counterclockwise movements indicated by arrows 52 or 54 to effect the locking orientation or the releasing orientation, respectively, are independent of the manual axial movements indicated by arrows 56 or 58 (see FIG. 2) to effect joinder or separation, respectively, of the lamp base 14 and the husk 16. Thus, while joinder or separation of the lamp base 14 and husk 16 is effected by relative manual movement of the two members 14, 16 along their common axis (that is, in the direction of arrows 56, 58), movement of the clip free end portion 46 between the locking orientation and the releasing orientation is effected by a manual movement which is clockwise or counterclockwise pivotal or rotational (as indicated by the arrows 52, 54) and has a substantial component transverse to the common axis of the lamp base 14 and husk 16. Accordingly, the positive interlock may be effected or broken without any relative displacement of the lamp base housing 24 or husk housing 26 (provided, of course, that the members 14, 16 are initially in the appropriate coaxial and telescoped disposition).

In the locking orientation the post free end 32 is disposed to one side of the clip free end portion 46 (that is, the outer side thereof), and in the releasing orientation the post free end 32 is disposed on the opposite side of the clip free end portion 46 (that is, the inner side thereof). While the relative disposition of the post free end 32 and clip free end portion 46 in the locking orientation is maintained by an interference or snap fit therebetween, it will be appreciated that there is no substantial tendency for the clip free end portion 46 to return to the releasing orientation except for any relatively slight resiliency exhibited by the living hinge 44. Indeed, the forces tending to separate the lamp base 14 and husk 16 tend to maintain the clip free end portion 46 in the locking orientation with the clip aperture 50 seated on the constricted post portion 34.

The clip free end portion 46 extends appreciably beyond the aperture 50 toward the free end thereof so as to provide a grasping surface and thereby facilitate manual movement of the clip free end portion 46 between the locking and releasing orientations. In the locking orientation this appreciably extending clip portion 46, the bottom surface of the post 30, and the portion of the husk housing 26 opposite the appreciably extending clip portion 46 in combination form a U-shaped groove or recess which may be used to support the assembly 10 on an external support (not shown). To this end, the appreciably extending clip portion 46 preferably extends substantially beyond the aperture 50 (for example, about one centimeter beyond).

The portion of the clip 40 about the aperture 50 is preferably of reduced cross sectional area relative to the other portions thereof (except the living hinge 44) so as to enable the aperture 50 to resiliently enlarge slightly as the post free end 32 is forcibly passed therethrough during movement of the clip free end portion 46 to and from the locking orientation. Additionally the bottom wall 50*a* of clip aperture 50 is tilted or beveled upwardly and outwardly when the clip is in the locking orientation to facilitate insertion of the post end 32 through the clip aperture 50, the beveled bottom wall 50*a* acting to deflect the post end 32 slightly in an upward direction during the insertion procedure.

The term "positive interlock" as used herein and in the claims refers to the disposition of two elements such that a portion of one element physically enters into (and preferably passes through) a groove or recess (or preferably an aperture) in a portion of the other element.

To summarize, the present invention provides a positive interlocking lamp base/husk assembly. The positive interlocking means is integral with the lamp base and/or husk so that it does not need to be separately molded and cannot become lost. The positive interlock is effected by a manual movement other than that normally used to join together or separate the husk and lamp base assembly members.

It will be appreciated that, while in the preferred embodiment illustrated the post 30 is disposed on the husk 16 and the clip 40 is disposed on the lamp base 14, in an alternative embodiment (not shown) the post 30 may be disposed on the lamp base 14 and the clip 40 may be disposed on the husk 16.

Now that the preferred embodiments of the present invention have been shown and described in detail, various modifications and improvements thereon will become readily apparent to those skilled in the art. Accordingly, the appended claims are to be construed broadly and in a manner consistent with the spirit and scope of the invention described herein.

I claim:

1. A lamp base/husk assembly comprising:

(A) an elongate lamp base member;

(B) an elongate husk member configured and dimensioned to receive coaxially and telescopically therein and to release therefrom a portion of said lamp base member; and (C) unbiased means, integral in part with said lamp base member and in part with said husk member, for effecting a positive interlock of said members in a coaxial and telescoped disposition and releasing said interlock by a manual movement independent of the manual movement required to effect receipt of said members in said coaxial and telescoped disposition or separation of said members therefrom.

2. The assembly of claim 1 wherein said members are disposed in said coaxial and telescoped disposition and separated therefrom by relative axial movement thereof, said interlocking means effects such positive interlock and release thereof by a non-axial movement of said interlocking means, and said interlocking means is movable between a first position wherein it effects such positive interlocking and a second position wherein it effects such release thereof, without being appreciably biased towards either position.

3. In a push-in lamp base/husk assembly comprising:

(A) an elongate lamp base member, and (B) an elongate husk member configured and dimensioned to receive coaxially and telescopically therein and to release therefrom a portion of said lamp base member;

the improvement wherein one of said husk and lamp base members defines a first housing and an integral outwardly projecting lug, and the other of said members defines a second housing and an integral locking element; said locking element having a free end portion, a living hinge connecting said second housing and said free end portion, and an aperture extending through said free end portion configured and dimensioned to receive therein a portion of said lug to positively interlock said members; said free end portion being repeatedly movable relative to said second housing at said living hinge between a locking orientation wherein said lug extends through said aperture and a releasing orientation wherein said lug does not enter said aperture by manual movement of said free end portion independent of the manual movement required to effect either receipt of said lamp base member within said husk member or release of said lamp base member from said husk member.

4. The assembly of claim 3 wherein said one member is said husk member and said other member is said lamp base member.

5. The assembly of claim 3 wherein said free end of said lug is disposed to one side of said free end portion of said locking element in said locking orientation and on the opposite side of said free end portion of said locking element in said releasing orientation.

6. The assembly of claim 3 wherein said locking element additionally includes an outwardly projecting portion intermediate said second housing and said living hinge.

7. The assembly of claim 6 wherein said intermediate portion of said locking element is substantially rigid and said free end portion thereof is at least relatively rigid.

8. The assembly of claim 3 wherein said free end portion is at least relatively rigid.

9. The assembly of claim 3 wherein in said locking orientation said aperture and said lug form an interference fit.

10. The assembly of claim 3 wherein said members are configured and dimensioned such that the manual movement required to effect either receipt of said lamp base member within said husk member or release of said lamp base member from said husk member is a substantially axially directed movement, and the manual movement of said free end portion between said locking orientation and said releasing orientation is a substantially non-axially directed movement.

11. In a push-in lamp base/husk assembly comprising:

(A) an elongate lamp base member, and (B) an elongate husk member configured and dimensioned to receive coaxially and telescopically therein and to release therefrom a portion of said.-.lamp base member;

the improvement wherein said husk member defines a first housing and an integral outwardly projecting lug, and said lamp base member defines a second housing and an integral locking element; said locking element having a substantially rigid portion projecting outwardly from said second housing, a relatively rigid free end portion, a living hinge connecting said outwardly projecting portion and said free end portion, and an aperture extending through said free end portion configured and dimensioned to receive therein a portion of said lug to positively interlock said members; said free end portion being repeatedly movable relative to said second housing at said living hinge, between a locking orientation wherein said lug extends through said aperture and forms therewith an interference fit and a releasing orientation wherein said lug does not enter said aperture, by manual movement of said free end portion independent of the manual movement required to effect either receipt of said lamp base member within said husk member or release of said lamp base member from said husk member; said free end of said lug being disposed to one side of said free end portion of said locking element in said locking orientation and on the opposite side of said free end portion of said locking element in said releasing orientation; said members being configured and dimensioned such that the manual movement required to effect either receipt of said lamp base member within said husk member or release of said lamp base member from said husk member is a substantially axially directed movement and said movement of said free end portion between said locking orientation and said releasing orientation is a substantially non-axially directed movement; said free portion extending substantially beyond said aperture and in said locking orientation the length of said free end portion beyond said aperture defining with said lug and first housing of said one member a generally inverted U-shaped recess for support of said assembly as a unit on an external support.

12. In a push-in lamp base/husk assembly comprising:

(A) an elongate lamp base member, and (B) an elongate husk member configured and dimensioned to receive coaxially and telescopically therein and to release therefrom a portion of said lamp base member;

the improvement wherein one of said husk and lamp base members defines a first housing and an integral outwardly projecting lug, and the other of said members defines a second housing and an integral locking element; said locking element having a free end portion, a living hinge connecting said second housing and said free end portion, and an aperture extending through said fee end portion configured and dimensioned to receive therein a portion of said lug to positively interlock said members; said free end portion being repeatedly movable relative to said second housing at said living hinge between a locking orientation wherein said lug extends through said aperture and a releasing orientation wherein said lug does not enter said aperture by manual movement of said free end portion independent of the manual movement required to effect either receipt of said lamp base member within said husk member of release of said lamp base member from said husk member, said free end portion extending substantially beyond said aperture and in said locking orientation the length of said free end portion beyond said aperture defining with said lug and first housing of said one member a generally inverted U-shaped recess for support of said assembly as a unit on an external support.

13. The assembly of claim 12 wherein said locking element additionally includes an outwardly projecting portion intermediate said second housing and said living hinge.

* * * * *